US007484491B2

(12) United States Patent
Arruda et al.

(10) Patent No.: US 7,484,491 B2
(45) Date of Patent: Feb. 3, 2009

(54) AIR INDUCTION SYSTEM WITH RESONATOR BYPASS VALVE

(75) Inventors: Anthony Charles Arruda, Ann Arbor, MI (US); James Bryan Bielicki, Livonia, MI (US); Mark Douglas Conley, Westland, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/772,949

(22) Filed: Jul. 3, 2007

(65) Prior Publication Data

US 2009/0007876 A1 Jan. 8, 2009

(51) Int. Cl.
*F02M 35/10* (2006.01)

(52) U.S. Cl. ..... 123/184.57; 123/184.56; 181/229

(58) Field of Classification Search ..... 123/184.56, 123/184.57; 181/229
See application file for complete search history.

(56) References Cited

U.S. PATENT DOCUMENTS

| | | | | |
|---|---|---|---|---|
| 2,781,032 | A * | 2/1957 | Sebok et al. | 123/556 |
| 4,622,926 | A | 11/1986 | Rutschmann et al. | |
| 4,829,941 | A | 5/1989 | Hitomi et al. | |
| 4,846,117 | A | 7/1989 | Hitomi et al. | |
| 5,031,598 | A | 7/1991 | Ueda et al. | |
| 5,056,473 | A | 10/1991 | Asaki et al. | |
| 5,377,629 | A | 1/1995 | Brackett et al. | |
| 5,771,851 | A | 6/1998 | McLean | |
| 6,192,850 | B1 | 2/2001 | Rutschmann et al. | |
| 6,250,272 | B1 | 6/2001 | Rutschmann et al. | |
| 6,332,442 | B1 * | 12/2001 | Komada et al. | 123/184.55 |
| 6,382,161 | B1 * | 5/2002 | Alex et al. | 123/184.53 |
| 6,418,900 | B2 | 7/2002 | Itou | |
| 6,423,108 | B1 * | 7/2002 | Mueller | 123/198 E |
| 6,450,141 | B1 * | 9/2002 | Sakuma | 123/184.57 |
| 6,557,511 | B2 | 5/2003 | Rutschmann et al. | |
| 6,732,509 | B2 | 5/2004 | Shiga | |
| 6,758,304 | B1 | 7/2004 | McLean | |
| 6,805,087 | B2 | 10/2004 | Yakabe et al. | |
| 6,959,679 | B2 | 11/2005 | Concialdi | |
| 7,077,093 | B2 | 7/2006 | Koelmel et al. | |
| 7,089,921 | B2 | 8/2006 | Matsuoka et al. | |
| 7,117,974 | B2 | 10/2006 | Moenssen et al. | |
| 7,171,933 | B2 | 2/2007 | Fegg et al. | |
| 7,287,503 | B2 * | 10/2007 | Suzuki | 123/184.53 |
| 2006/0086564 | A1 | 4/2006 | Kostun et al. | |
| 2006/0168920 | A1 * | 8/2006 | Cassell et al. | 55/311 |

FOREIGN PATENT DOCUMENTS

| | | | |
|---|---|---|---|
| JP | 2004076657 | A * | 3/2004 |
| JP | 2005201204 | A * | 7/2005 |

* cited by examiner

*Primary Examiner*—Noah Kamen
(74) *Attorney, Agent, or Firm*—Fraser Clemens Martin & Miller LLC; J. Douglas Miller

(57) ABSTRACT

An air induction system for a vehicle is disclosed, wherein the air induction system includes a resonator bypass valve for control of an air flow to an engine and engine induction noise levels emitted therefrom.

12 Claims, 2 Drawing Sheets

AIR INDUCTION SYSTEM WITH RESONATOR BYPASS VALVE

FIELD OF THE INVENTION

The present invention relates generally to an air induction system and more particularly to an air induction system including a resonator bypass valve for controlling air flow to an engine and engine induction noise emitted therefrom.

BACKGROUND OF THE INVENTION

An internal combustion engine in a vehicle typically includes an air induction system for providing air to the engine. It is desirable to design the air induction system to maximize air flow to the engine, while minimizing noise emitted therefrom. One method to maximize air flow to the engine is to increase the size of a main air inlet orifice, which controls the amount of air permitted to flow into the system. However, increasing the size of the main air inlet orifice typically increases induction noise which is generated as air is drawn into the engine.

Resonators of various types have been employed to reduce engine induction noise by reflecting sound waves generated by the engine 180 degrees out of phase. The combination of the sound waves generated by the engine with the out of phase sound waves results in a reduction or cancellation of the amplitude of the sound waves. Such resonators typically include a single, fixed volume chamber for dissipating the engine induction noise. Multiple resonators are frequently required to attenuate sound waves of different frequencies. The function of resonators as described herein is described in commonly owned U.S. patent application Ser. No. 11/521,934 hereby incorporated herein by reference in its entirety. While resonators have been effective at reducing induction noise, air induction systems including resonators tend to minimize air flow to the engine, adversely affecting engine performance.

It would be desirable to produce an air induction system including a resonator bypass valve for maximizing air flow to an engine and minimizing noise emitted therefrom.

SUMMARY OF THE INVENTION

Harmonious with the present invention, an air induction system including a resonator bypass valve for maximizing air flow to an engine and minimizing noise emitted therefrom, has surprisingly been discovered.

In one embodiment, an air induction system comprises: a main inlet duct having a first end and a second end, the second end in fluid communication with an air filter box; a secondary inlet duct in fluid communication with at least one of the main inlet duct and the air filter box; and a valve in fluid communication with the secondary inlet duct adapted to selectively permit and militate against a flow of a fluid through the secondary inlet duct.

In another embodiment, an air induction system comprises: a main inlet duct having a first end in fluid communication with the atmosphere and a second end in fluid communication with an air filter box; a secondary inlet duct having a first end in fluid communication with at least one of the main inlet duct and the atmosphere and a second end in fluid communication with at least one of the main inlet duct and the air filter box; a valve disposed between the main inlet duct and the secondary inlet duct, wherein the valve selectively permits and militates against a flow of a fluid between the main inlet duct and the secondary inlet duct; and a controller to selectively open and close the valve.

In another embodiment, an air induction system comprises: a main inlet duct having a first end in fluid communication with the atmosphere and a second end in fluid communication with an air filter box; a secondary inlet duct having a first end in fluid communication with at least one of the main inlet duct and the atmosphere and a second end in fluid communication with at least one of the main inlet duct and the air filter box; a valve disposed in the secondary inlet duct, wherein the valve selectively permits and militates against a flow of a fluid through the secondary inlet duct; and a controller to selectively open and close the valve.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
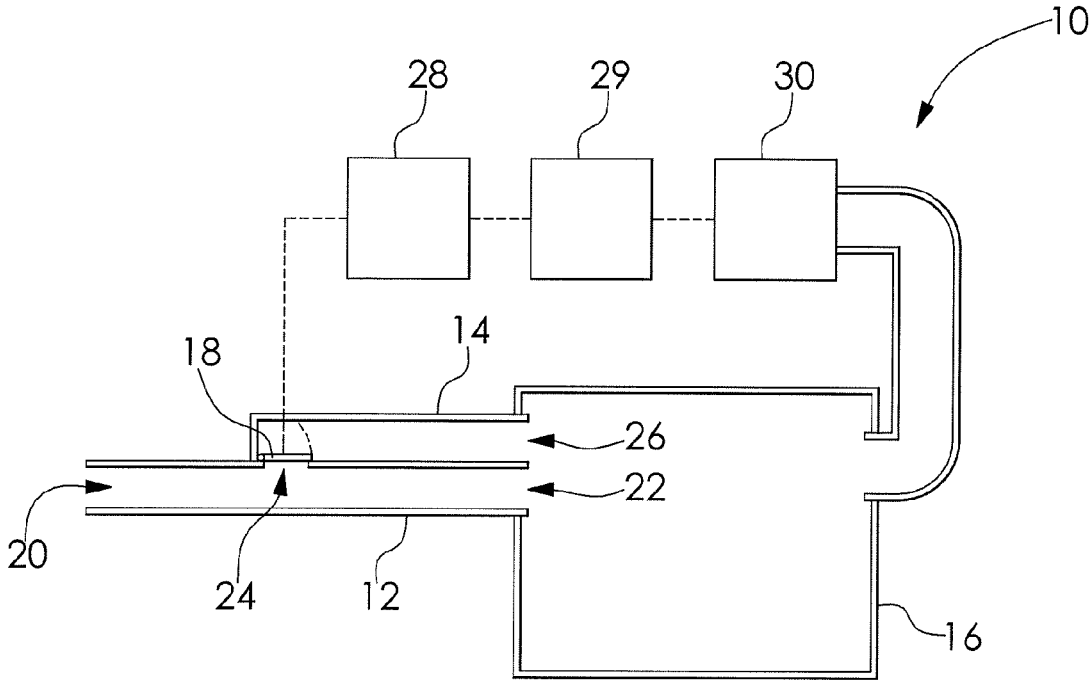
FIG. 1 is a schematic diagram of an air induction system in accordance with an embodiment of the invention.

FIG. 1 shows a vehicle air induction system (AIS) 10 according to an embodiment of the invention. The AIS 10 includes a main inlet duct 12, a secondary inlet duct 14, and a hollow air filter box 16. A valve 18, such as a butterfly valve, a rotating partition valve, a rotating door valve, or a sliding door valve, for example, is disposed between and provides fluid communication between the main inlet duct 12 and the secondary inlet duct 14. The valve 18 may also be positioned at other locations in the secondary inlet duct 14 as desired, including at an interface between the secondary inlet duct 14 and the air filter box 16, for example.

The main inlet duct 12 is formed from any suitable material such as a plastic or aluminum, for example, and includes a first open end 20 that is open to the atmosphere, for example. It is understood that the first open end 20 may be in fluid communication with other locations as desired without departing from the scope and spirit of the invention. The main inlet duct 12 includes a second open end 22 that is in fluid communication with an interior of the air filter box 16.

The secondary inlet duct 14 is formed from any suitable material such as a plastic or aluminum, for example, and includes a first end 24 that is in fluid communication with the main inlet duct 12 when the valve 18 is in an open position. Fluid communication between the main inlet duct 12 and the secondary inlet duct 14 is militated against when the valve 18 is in a closed position. The secondary inlet duct 14 includes a second open end 26 that is in fluid communication with the interior of the air filter box 16.

The valve 18 is controlled by a controller 28. The controller 28 is in communication with an engine speed sensor 29, which is in communication with an engine 30. The engine 30 is in fluid communication with the air filter box 16. It is understood that the engine 30 and the air filter box 16 can be in fluid communication with other structures. The air filter box 16 typically includes an air filter element (not shown). It is understood that other components can be included in the AIS 10, as desired, such as a resonator, for example.

In use, the controller 28 receives a signal from the engine speed sensor 29 based on a rotation speed of the engine 30 in rotations per minutes (RPM). The controller 28 opens and closes the valve 18 based on the speed of the engine 30. For example, when the speed of the engine 30 reaches a predetermined high level, the valve 18 is opened to maximize an amount of air permitted to flow to the engine 30. The maximized air flow to the engine 30 maximizes a performance of the engine 30. When the speed of the engine 30 reaches a predetermined low level, the valve 18 is closed to minimize a noise level emitted through the AIS 10 by reducing the area with is in fluid communication with the first open end 20. Additionally, when the valve 18 is in the closed position, the secondary inlet duct 14, acting as an acoustic wave tuner, further minimizes the noise level emitted form the AIS 10. With the valve 18 in the closed position, an acoustic quarter wave tuning effect is facilitated. It is understood that the location of the valve 18 may be adjusted to optimize the tuning effect. Accordingly, the AIS 10 can be used both to maximize the performance of the engine 30 and to minimize noise levels emitted therefrom. Additionally, a complexity and a cost of the AIS 10 are minimized. It is understood that the controller 28 may open or close the valve 18 based on other conditions as desired, such as a throttle position, for example, without departing from the scope and spirit of the invention.

Figure 2:
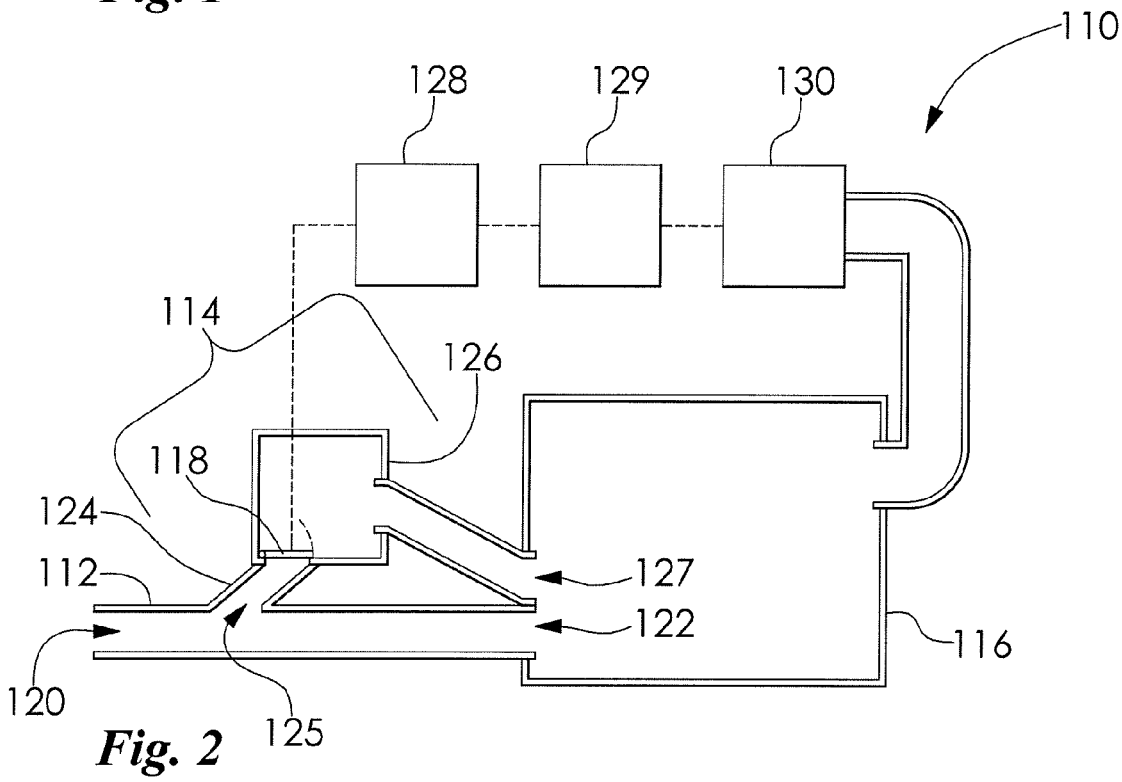
FIG. 2 is a schematic diagram of an air induction system in accordance with another embodiment of the invention.

FIG. 2 shows a vehicle air induction system (AIS) 110 according to another embodiment of the invention. The AIS 110 includes a main inlet duct 112, a secondary inlet duct 114, and a hollow air filter box 116. A valve 118, such as a butterfly valve, a rotating partition valve, a rotating door valve, or a sliding door valve, for example, is disposed in the secondary inlet duct 114.

The main inlet duct 112 is formed from any suitable material such as a plastic or aluminum, for example, and includes a first open end 120 that is open to the atmosphere. It is understood that the first open end 120 may be in fluid communication with other locations as desired. The main inlet duct 112 includes a second open end 122 that is in fluid communication with an interior of the air filter box 116.

The secondary inlet duct 114 is formed from any suitable material such as a plastic or aluminum, for example. The secondary inlet duct 114 includes a first resonator 124 disposed in a first portion of the secondary inlet duct between the main inlet duct 112 and the valve 118. The secondary inlet duct 114 includes a second resonator 126 disposed between the valve 118 and the air filter box 116. The first resonator 124 includes a first open end 125 that is in fluid communication with the main inlet duct 112. It is understood that the first open end 125 could be in fluid communication with other locations, as desired. The second resonator 126 includes a second open end 127 that is in fluid communication with the air filter box 116. When the valve 118 is in an open position, fluid communication between the first resonator 124 and the second resonator 126 is permitted. When the valve 118 is in a closed position, fluid communication between the first resonator 124 and the second resonator 126 is militated against. The first resonator 124 and the second resonator 126 can be any conventional type such as a quarter wave tuner, Helholz resonator, and the like, for example. The valve 118 may also be located at other positions in either the first resonator 124 or the second resonator 126 as desired.

The valve 118 is controlled by a controller 128. The controller 128 is in communication with an engine speed sensor 129, which is in communication with an engine 130. The engine 130 is in fluid communication with the air filter box 116. It is understood that the engine 130 and the air filter box 116 can be in fluid communication with other structures. The air filter box 116 typically includes an air filter element (not shown). It is understood that other components can be included in the AIS 110 without departing from the scope and spirit of the invention.

In use, the controller 128 receives a signal from the engine speed sensor 129 based on a rotation speed of the engine 130 in rotations per minute (RPM). The controller 128 opens and closes the valve 118 based on the speed of the engine 130. For example, when the speed of the engine 130 reaches a predetermined high level, the valve 118 is opened to maximize an amount of air permitted to flow to the engine 130. The maximized air flow to the engine 130 maximizes a performance of the engine 130. When the speed of the engine 130 reaches a predetermined low level, the valve 118 is closed to minimize a noise level emitted through the AIS 110. When the valve 118 is in a closed position, the first resonator 124 and the second resonator 126 minimize noise produced by the engine 130 by reflecting sound waves generated by the engine 130 180 degrees out of phase. The valve 118 may also be located at other positions in either the first resonator 124 or the second resonator 126 to facilitate the desired tuning. Accordingly, the AIS 110 can be used both to maximize the performance of the engine 130 and to minimize noise levels emitted therefrom. Additionally, a complexity and a cost of the AIS 110 are minimized. It is understood that the controller 128 may open or close the valve 118 based on other conditions as desired, such as a throttle position, for example, without departing from the scope and spirit of the invention.

Figure 3:
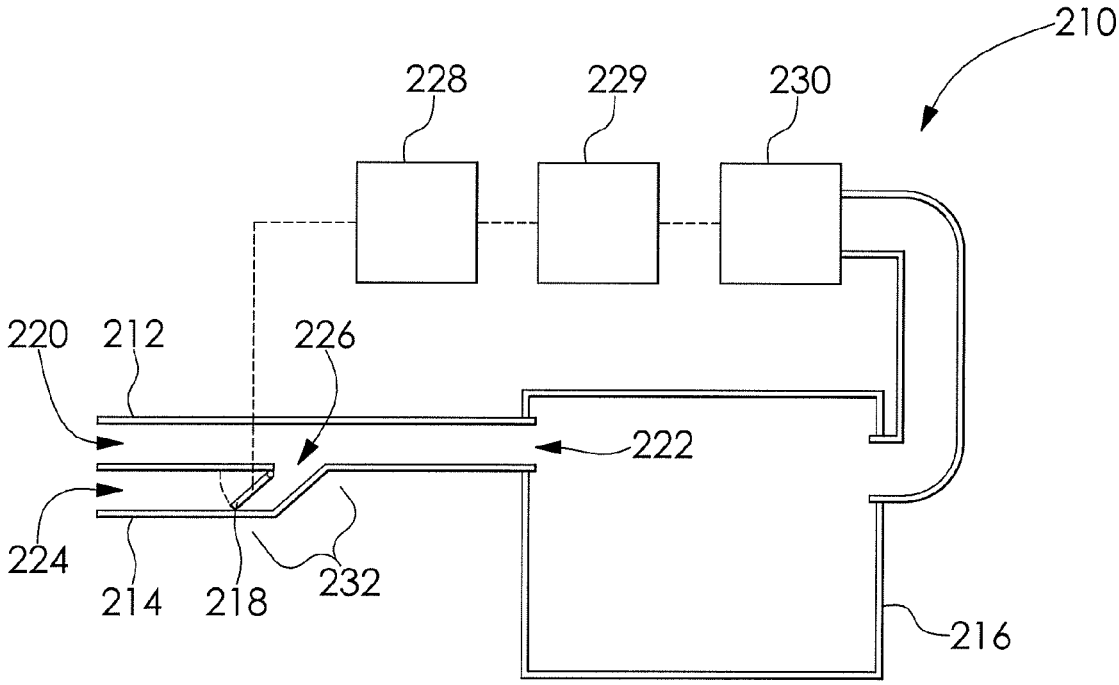
FIG. 3 is a schematic diagram of an air induction system in accordance with another embodiment of the invention.

FIG. 3 shows a vehicle air induction system (AIS) 210 according to another embodiment of the invention. The AIS 210 includes a main inlet duct 212, a secondary inlet duct 214 and a hollow air filter box 216. A valve 218, such as a butterfly valve, a rotating partition valve, a rotating door valve, or a sliding door valve, for example, is disposed between and provides fluid communication between the main inlet duct 212 and the secondary inlet duct 214.

The main inlet duct 212 is formed from any suitable material such as a plastic or aluminum, for example, and includes a first open end 220 that is open to the atmosphere. It is understood that the first open end 220 may be in fluid communication with other locations as desired without departing from the scope and spirit of the invention. The main inlet duct 212 includes a second open end 222 that is in fluid communication with an interior of the air filter box 216.

The secondary inlet duct 214 is formed from any suitable material such as a plastic or aluminum, for example, and includes a first open end 224 that is open to the atmosphere. It is understood that the first open end 224 may include a valve (not shown) to selectively open and close the first open end 224 as desired. It is also understood that the first open end 224 can be in fluid communication with other locations as desired, such as the main inlet duct 212, for example. A second open end 226 of the secondary inlet duct 214 is in fluid communication with the main inlet duct 212. The valve 218 is disposed in the secondary inlet duct 214 at a position intermediate the first open end 224 and the second open end 226 thereof. The valve 218 militates against fluid communication between the secondary inlet duct 214 and the main inlet duct 212 while in a closed position, and facilitates fluid communication between the secondary inlet duct 214 and the main inlet duct 212 while in an open position.

The valve 218 is controlled by a controller 228. The controller 228 is in communication with an engine speed sensor 229, which is in communication with an engine 230. The engine 230 is in fluid communication with the air filter box 216. It is understood that the engine 230 and the air filter box 216 can be in fluid communication with other structures. The air filter box 216 typically includes an air filter element (not shown). It is understood that other components can be included in the AIS 210 as desired.

In use, the controller 228 receives a signal from the engine speed sensor 229 based on a rotation speed of the engine 230 in rotations per minute (RPM). The controller 228 opens and closes the valve 218 based on the speed of the engine 230. For example, when the speed of the engine 230 reaches a predetermined high level, the valve 218 is opened to maximize an amount of air permitted to flow to the engine 230. The maximized air flow to the engine 230 maximizes a performance of the engine 230. When the speed of the engine 230 reaches a predetermined low level, the valve 218 is closed to minimize a noise level emitted through the AIS 210. When the valve 218 is in a closed position, a portion of the secondary inlet duct 214 between the valve 218 and the second open end 226 acts as a first resonator 232, wherein the first resonator 232 can be used to minimize noise produced by the engine 230 by reflecting sound waves generated by the engine 230 180 degrees out of phase, thereby minimizing noise emitted from the AIS 210. Accordingly, the AIS 210 can be used both to maximize the performance of the engine 230 and to minimize noise levels emitted therefrom. Additionally, a complexity and a cost of the AIS 210 are minimized. It is understood that the controller 228 may open or close the valve 218 based on other conditions as desired, such as a throttle position, for example, without departing from the scope and spirit of the invention.

Figure 4:
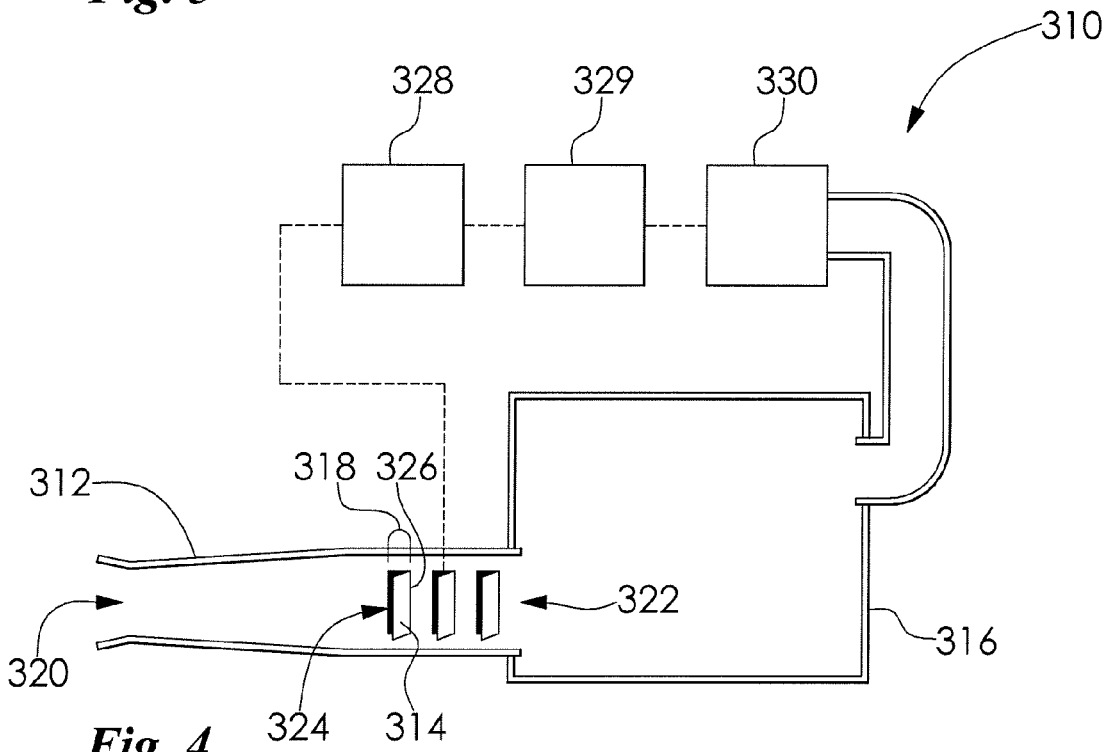
FIG. 4 is a schematic diagram of an air induction system in accordance with another embodiment of the invention.

FIG. 4 shows a vehicle air induction system (AIS) 310 according to another embodiment of the invention. The AIS 310 includes a main inlet duct 312, a plurality of adjustable valves or louvers 314, and a hollow air filter box 316.

The main inlet duct 312 is formed from any suitable material such as a plastic or aluminum, for example, and includes a first open end 320 that is open to the atmosphere. It is understood that the first open end 320 may be in fluid communication with other locations as desired without departing from the scope and spirit of the invention. The main inlet duct 312 includes a second open end 322 that is in fluid communication with an interior of the air filter box 316.

The valves 314 are formed from any suitable material such as a plastic or aluminum, for example, and include first open ends 324 that are open to the atmosphere when the valves 314 are in an open position. It is understood that the first open ends 324 may be in fluid communication with other locations as desired without departing from the scope and spirit of the invention. The valves 314 include second ends 326 that are pivotally connected to a wall of the main inlet duct 312. It is understood that the second ends 326 may be connected to other structure such as a wall forming the air filter box 316, for example. In the embodiment shown, secondary inlet ducts 318 are formed between the first open ends 324 of the valves 314 and the second ends 326 of the valves 314. The secondary inlet ducts 318 provide fluid communication between the atmosphere and the main inlet duct 312 while the valves 314 are in the open position. The valves 314 militate against fluid communication between the atmosphere and the main inlet duct 312 when in the closed position.

The valves 314 are controlled by a controller 328. The controller 328 is in communication with an engine speed sensor 329, which is in communication with an engine 330. The engine 330 is in fluid communication with the air filter box 316. It is understood that the engine 330 and the air filter box 316 can be in fluid communication with other structures. The air filter box 316 typically includes an air filter element (not shown). It is understood that additional components, such as a resonator, for example, can be included in the AIS 310 as desired.

In use, the controller 328 receives a signal from the engine speed sensor 329 based on a rotation speed of the engine 330 in rotations per minute (RPM). The controller 328 opens and closes the valves 314 based on the speed of the engine 330. For example, when the speed of the engine 330 reaches a predetermined high level, the valves 314 are opened to maximize an amount of air permitted to flow to the engine 330. The maximized air flow to the engine 330 maximizes a performance of the engine 330. When the speed of the engine 330 reaches a predetermined low level, the valves 314 are closed to minimize a noise level emitted through the AIS 310. Accordingly, the AIS 310 can be used both to maximize the performance of the engine 330 and to minimize noise levels emitted therefrom. Additionally, a complexity and a cost of the AIS 310 are minimized. It is understood that the controller 328 may open or close the valves 318 based on other conditions as desired, such as a throttle (not shown) position, for example, without departing from the scope and spirit of the invention.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An air induction system comprising:

a main inlet duct having a first end and a second end, the second end in fluid communication with an air filter box;

a secondary inlet duct having a first end and a second end, the first end in fluid communication with the main inlet duct and the second end in fluid communication with the air filter box; and a valve disposed in the secondary inlet duct adapted to selectively permit and militate against a flow of a fluid through the secondary inlet duct, the valve forming a first resonator for the main inlet duct in a portion of the secondary inlet duct between the valve and the first end of the secondary inlet duct and forming a second resonator for the air filter box in a portion of the secondary inlet duct between the valve and the second end of the secondary inlet duct when the valve is in a closed position.

2. The air induction system defined in claim 1, further comprising a controller to selectively open and close the valve.

3. The air induction system defined in claim 2, further comprising an engine speed sensor to sense and transmit an engine speed to the controller.

4. The air induction system defined in claim 3, wherein the controller selectively opens and closes the valve based upon the engine speed sensed by the engine speed sensor.

5. The air induction system defined in claim 1, including a resonator chamber in fluid communication with the secondary inlet duct disposed between the valve and the second end of the secondary inlet duct.

6. The air induction system defined in claim 1, wherein the valve is disposed at a position intermediate a first end of the secondary inlet duct and a second end of the secondary inlet duct.

7. The air induction system defined in claim 1, wherein the first end of the main inlet duct is in fluid communication with the atmosphere.

8. An air induction system comprising:

a main inlet duct having a first end in fluid communication with the atmosphere and a second end in fluid communication with an air filter box; and a secondary inlet duct having a first end and a second end including a valve disposed therein, the first end in fluid communication with the main inlet duct and the second end in fluid communication with the air filter box, wherein a first resonator and a second resonator are formed in the secondary inlet duct when the valve is in a closed position, the first resonator for the main inlet duct and the second resonator for the air filter box; and a controller to selectively open and close the valve.

9. The air induction system defined in claim 8, further comprising an engine speed sensor to sense and transmit engine speed to the controller.

10. The air induction system defined in claim 9, wherein the controller selectively opens and closes the valve based upon an engine speed sensed by the engine speed sensor.

11. The air induction system defined in claim 8, wherein the valve is disposed at a position intermediate the first end of the secondary inlet duct and the second end of the secondary inlet duct.

12. The air induction system defined in claim 8, including a resonator chamber in fluid communication with the secondary inlet duct.

* * * * *